US008994531B2

(12) United States Patent
Fawcett et al.

(10) Patent No.: US 8,994,531 B2
(45) Date of Patent: Mar. 31, 2015

(54) MERCHANDISE SENSOR AND METHOD FOR PROTECTING AN ITEM OF MERCHANDISE

(75) Inventors: Christopher J. Fawcett, Charlotte, NC (US); Jeffrey A. Grant, Charlotte, NC (US); Jonathon D. Phillips, Fort Mill, SC (US); Gary A. Taylor, Fort Mill, SC (US)

(73) Assignee: InVue Security Products Inc., Charlotte, NC (US)

( * ) Notice: Subject to any disclaimer, the term of this patent is extended or adjusted under 35 U.S.C. 154(b) by 229 days.

(21) Appl. No.: 13/565,432

(22) Filed: Aug. 2, 2012

(65) Prior Publication Data

US 2013/0033380 A1 Feb. 7, 2013

Related U.S. Application Data

(60) Provisional application No. 61/514,815, filed on Aug. 3, 2011, provisional application No. 61/537,725, filed on Sep. 22, 2011.

(51) Int. Cl.
*G08B 13/14* (2006.01)
*G08B 29/18* (2006.01)

(52) U.S. Cl.
CPC ..... *G08B 29/185* (2013.01); *G08B 13/1436* (2013.01); *G08B 13/1445* (2013.01)
USPC ..... 340/568.1; 340/568.2; 340/571

(58) Field of Classification Search
USPC ..... 340/568.1, 568.2, 571, 572.1, 652, 669, 340/561, 565, 687; 235/380, 383, 385; 705/22, 28
See application file for complete search history.

(56) References Cited

U.S. PATENT DOCUMENTS

| | | | | |
|---|---|---|---|---|
| 3,636,547 | A | 1/1972 | Brace et al. | |
| 3,932,857 | A | 1/1976 | Way et al. | |
| 4,746,909 | A * | 5/1988 | Israel et al. | 340/568.1 |
| 5,739,514 | A | 4/1998 | Uchida | |
| 6,970,095 | B1 | 11/2005 | Lee et al. | |
| 7,079,031 | B2 * | 7/2006 | Ott | 340/568.2 |
| 7,299,578 | B2 | 11/2007 | Molinaro | |
| 7,327,276 | B1 | 2/2008 | Deconinck et al. | |
| 7,564,351 | B2 | 7/2009 | Nagelski et al. | |
| 7,614,601 | B2 | 11/2009 | Marsilio et al. | |
| 7,626,500 | B2 | 12/2009 | Belden, Jr. et al. | |
| 7,701,339 | B2 | 4/2010 | Irmscher et al. | |

(Continued)

OTHER PUBLICATIONS

International Search Report of PCT/US2012/049461, Feb. 26, 2013, Korea.

*Primary Examiner* — Hung T. Nguyen
(74) *Attorney, Agent, or Firm* — InVue Security Products Inc.

(57) ABSTRACT

A merchandise sensor for protecting an item of merchandise displayed on a merchandise display security device from theft includes sensor electronics and a sensor element operably coupled to the sensor electronics. The sensor element provides an output value in an initial stable state before an interaction state and in a subsequent stable state following the interaction state. The sensor electronics compares the output value of the sensor element in the subsequent stable state and the output value of the sensor element in the initial stable state to determine whether a change in the output value indicates an alarm condition. In the event that the output value of the sensor element in the subsequent stable state is not within a predetermined tolerance bandwidth of the output value of the sensor element in the initial stable state, the sensor electronics activates an alarm in response to the alarm condition.

24 Claims, 6 Drawing Sheets

(56) References Cited

U.S. PATENT DOCUMENTS

| | | | | |
|---|---|---|---|---|
| 7,710,266 | B2 | 5/2010 | Belden, Jr. et al. | |
| 7,724,135 | B2 | 5/2010 | Rapp et al. | |
| 7,740,214 | B2 | 6/2010 | Marsilio et al. | |
| 8,013,740 | B2 | 9/2011 | Irmscher et al. | |
| 8,749,194 | B1 | 6/2014 | Kelsch et al. | |
| 2004/0113792 | A1* | 6/2004 | Ireland et al. | 340/572.8 |
| 2006/0097875 | A1 | 5/2006 | Ott | |
| 2007/0229259 | A1 | 10/2007 | Irmscher et al. | |
| 2009/0096607 | A1 | 4/2009 | Brosnan et al. | |
| 2011/0227735 | A1 | 9/2011 | Fawcett et al. | |
| 2011/0254661 | A1* | 10/2011 | Fawcett et al. | 340/5.61 |
| 2013/0033380 | A1 | 2/2013 | Fawcett et al. | |

* cited by examiner

MERCHANDISE SENSOR AND METHOD FOR PROTECTING AN ITEM OF MERCHANDISE

FIELD OF THE INVENTION

The present invention relates generally to sensors and methods for protecting merchandise. More particularly, the invention relates to a sensor for a merchandise display security device and a method for protecting an item of merchandise from theft. In exemplary embodiments, the invention is a sensor adapted for attachment to an item or merchandise that is secured on a merchandise display security device in a retail store to prevent, or at least deter, theft of the item by detecting a change in a variable or characteristic after interaction with the item of merchandise.

BACKGROUND OF THE INVENTION

It is common practice for retailers to display relatively expensive items of merchandise on a merchandise display security device, such as a display stand, an alarm module, a security fixture, and the like. The security device typically displays an item of merchandise so that a potential purchaser may readily view and evaluate the features and operation of the item before deciding whether to make a purchase. The item of merchandise is typically attached to a sensor that is secured on the merchandise display security device so as to prevent, or at least deter, theft of the item. The security device, the sensor, or both, may also include an audible and/or visible alarm that is activated to alert security personnel in the event of a possible theft.

Existing merchandise sensors monitor and determine the absolute state of attachment of the item of merchandise to the sensor. In other words, the sensor monitors and determines whether the item of merchandise is attached to the sensor (i.e., a "secure" or "non-alarm" condition) or whether the item of merchandise is not attached to the sensor (i.e., an "unsecured" or "alarm" condition). An alarm is activated in the event that the sensor determines an "unsecured" or "alarm" condition. As a result, the sensor is required to continuously monitor and determine the state of attachment of the item of merchandise to the sensor. Continuous absolute state sensing, however, has the specific disadvantages of producing an unacceptable number of false alarms and requiring greater power consumption. Furthermore, removable components of the item of merchandise typically must be attached to and monitored by a separate sensor. The use of multiple sensors complicates installation of the item of merchandise on the merchandise display security device and requires the retailer to maintain an inventory of different sensors. False alarms and multiple obtrusive sensors may negatively impact the experience of a potential purchaser interacting with the item of merchandise, and thus, can adversely impact sales of the item.

Accordingly, there exists an unresolved need for a sensor adapted for attachment to an item of merchandise to protect the item from theft that overcomes the disadvantages of existing merchandise display security device sensors. There exists a further, and more particular, need for a merchandise sensor that does not continuously monitor and determine an absolute state of the attachment of the item of merchandise to the sensor. There exists a further specific need for a merchandise sensor adapted for attachment to an item of merchandise and configured for use with a merchandise display security device that reduces the number of false alarms, reduces power consumption and does not require the use of a separate sensor to monitor a removable component of the item of merchandise.

BRIEF SUMMARY OF THE INVENTION

Embodiments of the present invention are directed to merchandise sensors for a merchandise display security device. In one embodiment, the merchandise sensor comprises sensor electronics and a sensor element operably coupled to the sensor electronics. The sensor element provides an output value in at least an initial stable state and a subsequent stable state following an interaction state. In addition, the sensor electronics compares the output value of the sensor element in the initial stable state and the output value of the sensor element in the subsequent stable state following the interaction state to determine an alarm condition.

In another embodiment, a merchandise sensor for protecting an item of merchandise from theft is provided. The merchandise sensor includes sensor electronics and a sensor element operably coupled to the sensor electronics. The sensor element is operable for generating an inductive energy field, and the sensor electronics is operable for monitoring changes in the inductive energy field to detect an alarm condition based on changes in the inductive energy field.

In one embodiment, a method for protecting an item of merchandise from theft is provided. The method includes generating an inductive energy field with a sensor element and monitoring changes in the inductive energy field with sensor electronics operably coupled to the sensor element. The method also includes determining an alarm condition with the sensor electronics based on changes in the inductive energy field.

BRIEF DESCRIPTION OF THE DRAWINGS

The detailed description of the invention provided herein may be better understood with reference to the accompanying drawing figures, which depict one or more exemplary, and in certain instances, preferred embodiments of a merchandise sensor constructed in accordance with the present invention.

DETAILED DESCRIPTION OF EMBODIMENTS OF THE INVENTION

Figure 1:
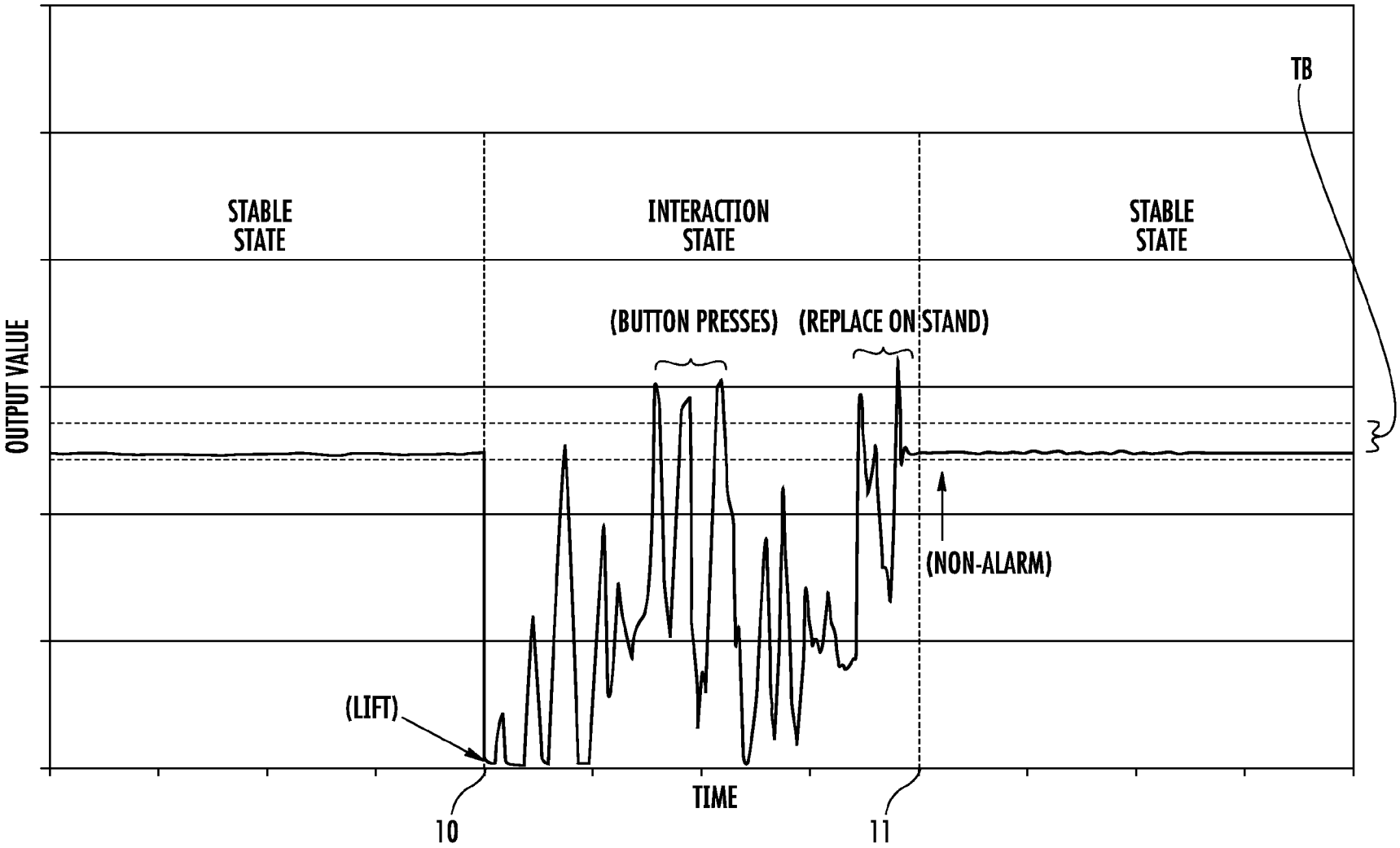
FIG. 1 is a graph illustrating a typical "secure" or "non-alarm" condition of a merchandise sensor according to the present invention.

Referring now to the accompanying drawing figures wherein like reference numerals denote like elements throughout the various views, one or more exemplary, and in certain instances, preferred embodiments of a merchandise sensor for protecting an item of merchandise are shown. Merchandise sensors according to the present invention are adapted for attachment to an item of merchandise, and typically, are configured to be secured on a merchandise display security device. Merchandise display security devices suitable for use with the invention include, but are not limited to, a display stand, an alarm module, a security fixture, and the like. In an exemplary embodiment, the merchandise sensor is configured to be removably supported on a merchandise display stand of the type available from InVue Security Products Inc. of Charlotte, N.C., USA. The sensor may be secured on the merchandise display security device by a mechanical, electrical or electromechanical cord or cable in a conventional manner. Alternatively, the merchandise sensor may be operably coupled by wireless communication to a merchandise display security device secured to a display support, such as a counter, tabletop, shelf, wall, or the like. Still further, the merchandise sensor may be a self-contained merchandise display security device housing an internal alarm in conjunction with range-finding or proximity sensing electronics, or alternatively, may be electrically coupled to an external alarm via a conductive cable, or wirelessly coupled to an external alarm in conjunction with range-finding or proximity sensing electronics. Furthermore, merchandise sensors according to the present invention may be used to monitor various characteristics of an item of merchandise or other goods article in virtually any setting or environment other than retail sales, as will be readily appreciated by those skilled in the art.

A merchandise sensor according to the present invention utilizes periodic duty cycle sensing and variable state detection as opposed to continuous detection of an absolute state of the attachment of the item of merchandise to the sensor. In this regard, the sensor may be considered to be "context-driven" and capable of monitoring and determining a change in an expected value of a variable or characteristic associated with the item of merchandise. In broad principle, the sensor determines an initial value of a variable or characteristic of the item of merchandise in a stable state and activates an alarm if a subsequent value of the variable or characteristic is not within a predetermined tolerance bandwidth about the initial value when the item of merchandise is returned to a stable state after an interaction state. The system continues to monitor and adjust the expected value with changes to environment and other conditions and continues to monitor dynamic changes.

In an exemplary embodiment, the sensor comprises sensor electronics in the form of a printed circuit board or equivalent and a sensor element operably coupled to the item of merchandise. For example, the sensor element may be an inductor electrically connected to the sensor electronics that generates an energy field by means of inductance so that changes in the energy field can be monitored by the sensor electronics. In a particular embodiment, the inductor generates a magnetic field by passing an electric current through a coil and changes in the strength of the magnetic field are monitored by the sensor electronics to detect an "unsecured" or "alarm" condition. When the item of merchandise is in a physically and environmentally stable state, for example while the item of merchandise is being supported on a merchandise display security device for display in a retail store, the sensor electronics records an initial output value provided by the sensor element. Preferably, the sensor electronics is configured to periodically calibrate to a new initial output value in order to compensate for any natural electrical drift of the sensor element as long as the item of merchandise remains in the same stable state. When the item of merchandise changes from the stable state to an interaction state, for example while a potential purchaser is evaluating the item of merchandise, the sensor electronics ignores the output value provided by the sensor element.

When the item of merchandise changes from the interaction state back to a stable state, for example after the potential purchaser has evaluated the item of merchandise, the sensor electronics records a subsequent output value provided by the sensor element and compares the initial output value of the first stable state to the subsequent output value of the new stable state. If the subsequent output value is within a predetermined tolerance bandwidth about the initial output value, the sensor electronics merely calibrates the initial output value to the subsequent output value and reassigns the tolerance bandwidth about the subsequent output value. If instead, the subsequent output value is not within (i.e., is outside) the predetermined tolerance bandwidth, the sensor electronics detects an "unsecured" or "alarm" condition and activates an alarm to alert security personnel to a possible theft.

FIG. 1 graphically illustrates a typical "secured" or "non-alarm" condition of a merchandise sensor configured in accordance with the present invention. A "secured" or "non-alarm" condition may occur, for example, when a potential purchaser lifts the item of merchandise attached to the merchandise sensor from a display stand, evaluates the features and operation of the item of merchandise, and subsequently replaces the item of merchandise onto the display stand without significant change to a variable or characteristic of the item of merchandise or the merchandise display. The vertical axis of the graph of FIG. 1 indicates the output value of a sensor element of the merchandise sensor, for example, an inductor electrically connected to the sensor electronics that generates an energy field by means of inductance so that changes in the energy field can be monitored by the sensor electronics. The horizontal axis of the graph of FIG. 1 indicates periodic time increments over which the sensor electronics is configured to sample, and in certain instances record, the output value of the sensor element. During a stable state, the sensor electronics preferably samples the output value provided by the sensor element periodically to calibrate an initial output value and thereby compensate for any natural electrical drift of the sensor element.

Until the time increment identified as 10, the item of merchandise is in a relatively stable state, for example, positioned in a desired display orientation on a merchandise display stand. Beginning at the time increment identified by 10, the potential purchaser lifts the item of merchandise and the merchandise sensor from the merchandise display stand and thereafter presses various buttons or keys to evaluate features and operation of the item of merchandise. Immediately prior to the time increment identified by 11, the potential purchaser replaces the item of merchandise and the merchandise sensor on the merchandise display stand. From the time increment 10 until the time increment 11, the item of merchandise is in an interaction state and the sensor electronics ignores the output values periodically provided by the sensor element. It should be noted that the interaction state may be determined by the rate of change of the output values provided by the sensor element, or alternatively, by a kinetic sensor, such as an accelerometer, load cell or equivalent, disposed within the merchandise sensor. Regardless, the item of merchandise remains in the interaction state until the item of merchandise is replaced in the desired display orientation on the merchandise display stand. Beginning at the time increment 11, the item of merchandise is in a subsequent stable state. Since the output values provided by the sensor element in the subsequent stable state are within a predetermined tolerance bandwidth identified by TB, the sensor electronics detects a "secured" or "non-alarm" condition and does not activate an alarm in response to the output value of the sensor element. Instead, the sensor electronics periodically samples the output value of the sensor element and calibrates a new initial output value to compensate for any natural electrical drift of the sensor element or a change in environmental conditions. If necessary, the sensor electronics also adjusts the range of the tolerance bandwidth TB about the new initial output value.

Figure 2:
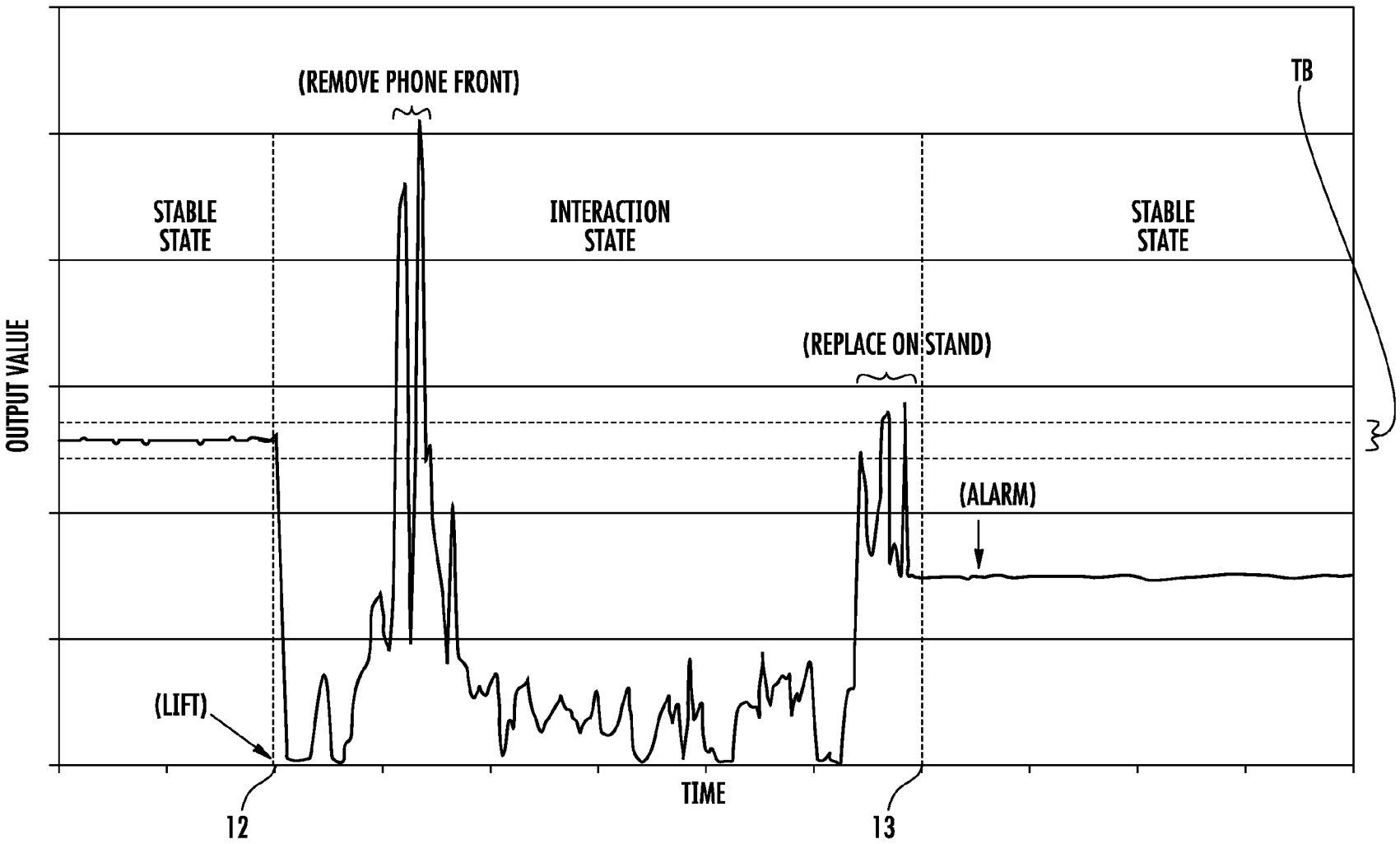
FIG. 2 is a graph illustrating a typical "unsecure" or "alarm" condition of a merchandise sensor according to the present invention indicating a possible theft of a removable component of an item of merchandise.

FIG. 2 graphically illustrates a typical "unsecured" or "alarm" condition of a merchandise sensor according to the present invention indicating a possible theft of a removable component of the item of merchandise. An "unsecured" or "alarm" condition indicating a theft event may occur, for example, when a potential thief lifts the item of merchandise attached to the merchandise sensor from a merchandise display stand, removes a removable component, such as a front cover or a battery compartment door, of the item of merchandise, and subsequently replaces the item of merchandise on the merchandise display stand. As mentioned with reference to FIG. 1, the vertical axis of the graph of FIG. 2 indicates the output value of a sensor element of the merchandise sensor, for example, an inductor electrically connected to the sensor electronics that generates a magnetic field by means of inductance so that changes in the energy field can be monitored by the sensor electronics. The horizontal axis of the graph of FIG. 2 indicates periodic time increments over which the sensor electronics is configured to sample, and in certain instances record, the output value of the sensor element. During a stable state, the sensor electronics preferably samples the output value provided by the sensor element periodically to calibrate an initial output value and thereby compensate for any natural electrical drift of the sensor element. FIG. 2 indicates the output value of a sensor element of the merchandise sensor, for example, an inductor electrically connected to the sensor electronics that generates a magnetic field by means of inductance so that changes in the energy field can be monitored by the electronics. The horizontal axis of the graph of FIG. 2 indicates periodic time increments over which the sensor electronics is configured to sample, and in certain instances record, the output value of the sensor element. During a stable state, the sensor electronics preferably samples the output value provided by the sensor element periodically to calibrate an initial output value and thereby compensate for any natural electrical drift of the sensor element.

Until the time increment identified by 12, the item of merchandise is in a relatively stable state, for example, positioned in a desired display orientation on a merchandise display stand. Beginning at the time increment 12, the potential thief lifts the item of merchandise and the merchandise sensor from the merchandise display stand and thereafter removes the removable component from the item of merchandise. Immediately prior to the time increment identified by 13, the potential thief replaces the item of merchandise and the merchandise sensor without the removable component onto the merchandise display stand. From the time increment 12 until the time increment 13, the item of merchandise is in an interaction state and the sensor electronics ignores the output values periodically provided by the sensor element. As previously mentioned, the interaction state may be determined by the rate of change of the output values provided by the sensor element, or alternatively, by a kinetic sensor, such as an accelerometer, load cell or equivalent, disposed within the merchandise sensor. Regardless, the item of merchandise remains in the interaction state until the item of merchandise is replaced in the desired display orientation on the merchandise display stand. Beginning at the time increment 13, the item of merchandise is in a subsequent stable state. However, the output values provided by the sensor element in the subsequent stable state are not within (i.e., are outside) the predetermined tolerance bandwidth TB. Accordingly, the sensor electronics detects an "unsecured" or "alarm" condition and activates an alarm in response to the output values of the sensor element to alert security personnel to a possible theft.

Figure 3:
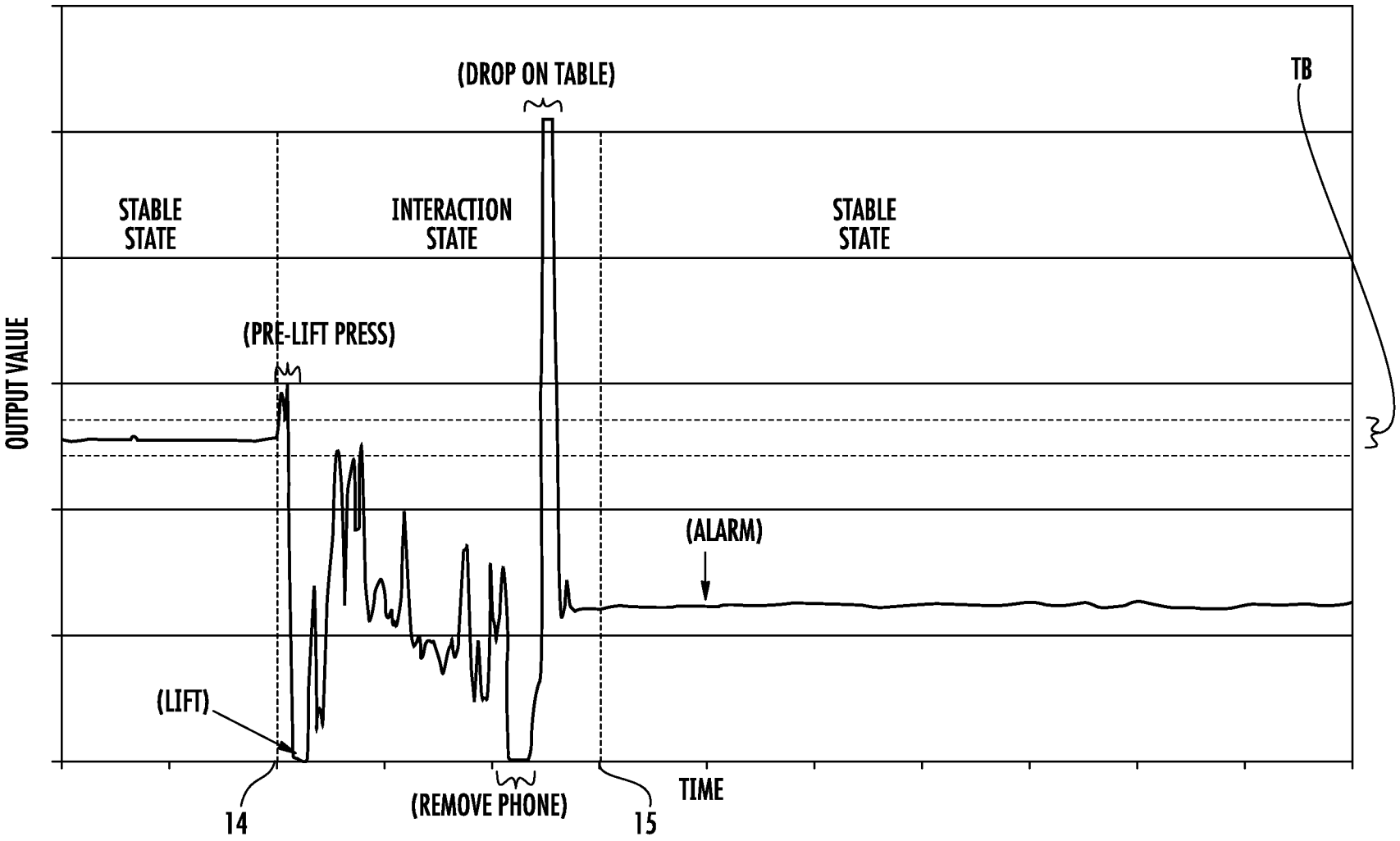
FIG. 3 is a graph illustrating another typical "unsecure" or "alarm" condition of a merchandise sensor according to the present invention indicating a possible theft of an item of merchandise.

FIG. 3 graphically illustrates another typical "unsecured" or "alarm" condition of a merchandise sensor according to the present invention indicating a possible theft of the entire item of merchandise. An "unsecured" or "alarm" condition indicating a theft event may occur, for example, when a potential thief lifts the item of merchandise attached to the merchandise sensor from a merchandise display stand, removes (i.e., detaches) the item of merchandise from the merchandise sensor, and subsequently drops the merchandise sensor without the item of merchandise onto a display support, such as a counter, tabletop, shelf, wall, or the like. As mentioned with reference to FIG. 1, the vertical axis of the graph of FIG. 3 indicates the output value of a sensor element of the merchandise sensor, for example, an inductor electrically connected to the sensor electronics that generates a magnetic field by means of inductance so that changes in the energy field can be monitored by the electronics. The horizontal axis of the graph of FIG. 3 indicates periodic time increments over which the sensor electronics is configured to sample, and in certain instances record, the output value of the sensor element. During a stable state, the sensor electronics preferably samples the output value provided by the sensor element periodically to calibrate an initial output value and thereby compensate for any natural electrical drift of the sensor element.

Until the time increment identified by 14, the item of merchandise is in a relatively stable state, for example, positioned in a desired display orientation on a merchandise display stand. Beginning at the time increment 14, the potential thief prematurely presses buttons or keys on the item of merchandise and then lifts the item of merchandise and the merchandise sensor from the merchandise display stand. The potential thief next removes (i.e., detaches) the item of merchandise from the merchandise sensor and thereafter drops the merchandise sensor without the item of merchandise onto the display support prior to the time increment identified by 15. From the time increment 14 until the time increment 15, the item of merchandise is in an interaction state and the sensor electronics ignores the output values periodically provided by the sensor element. As previously mentioned, the interaction state may be determined by the rate of change of the output values provided by the sensor element, or alternatively, by a kinetic sensor, such as an accelerometer, load cell or equivalent, disposed within the merchandise sensor. Regardless, the item of merchandise remains in the interaction state until the merchandise sensor comes to rest on the display support at the time increment 15. Thereafter, the merchandise sensor without the item of merchandise is in a subsequent stable state. However, the output values provided by the sensor element in the subsequent stable state are not within (i.e., are outside) the predetermined tolerance bandwidth TB. Accordingly, the sensor electronics detects an "unsecured" or "alarm" condition and activates an alarm in response to the output values of the sensor element to alert security personnel to a possible theft.

Figure 4:
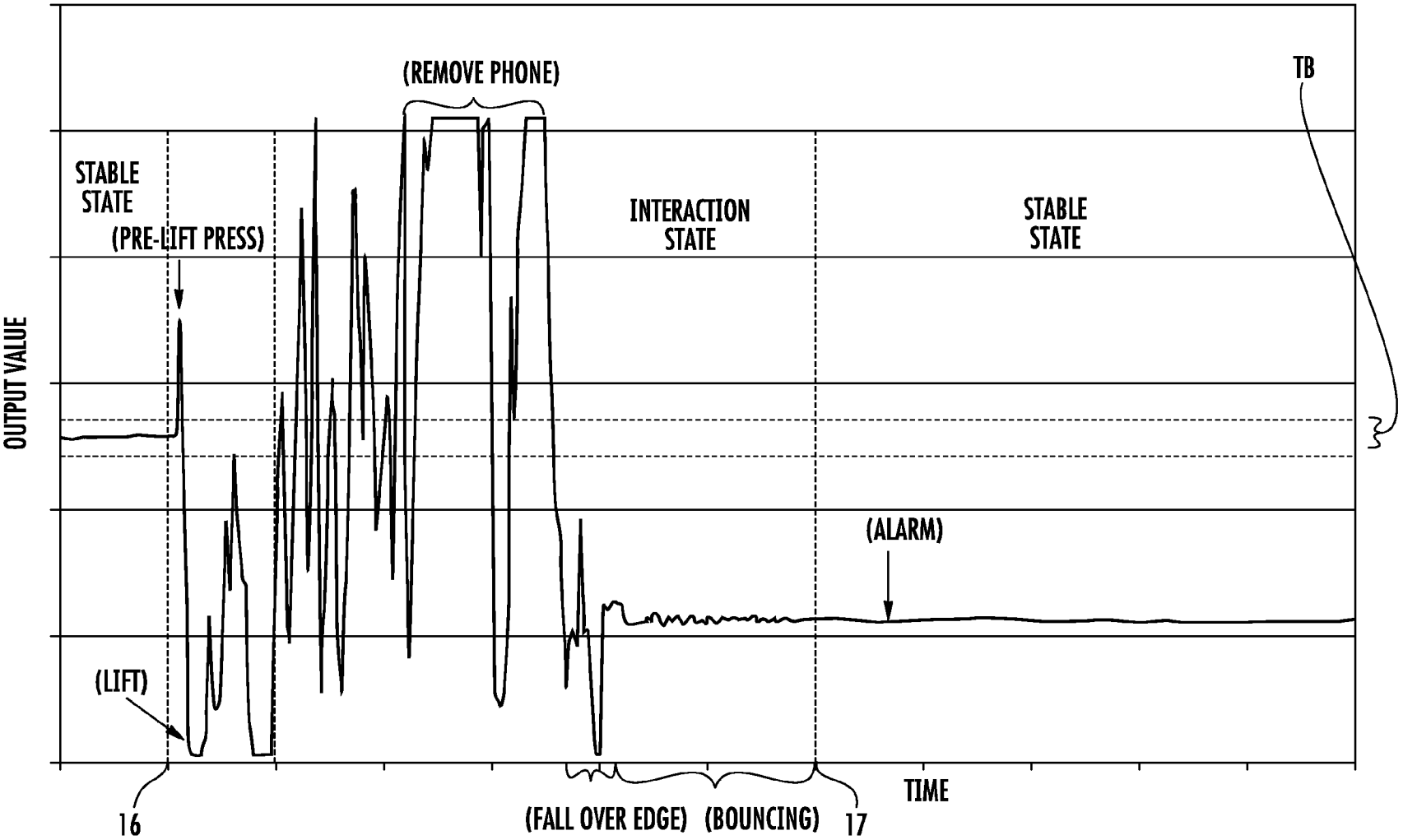
FIG. 4 is a graph illustrating another typical "unsecure" or "alarm" condition of a merchandise sensor according to the present invention indicating a possible theft of an item of merchandise.

FIG. 4 graphically illustrates another typical "unsecured" or "alarm" condition of a merchandise sensor according to the present invention indicating a possible theft of the entire item of merchandise. An "unsecured" or "alarm" condition indicating a theft event may occur, for example, when a potential thief lifts the item of merchandise attached to the merchandise sensor from a merchandise display stand, removes (i.e. detaches) the item of merchandise from the merchandise sensor, and subsequently drops the merchandise sensor without the item of merchandise over an edge of a display support, such as a counter, tabletop, shelf, wall, or the like. As mentioned with reference to FIG. 1, the vertical axis of the graph of FIG. 4 indicates the output value of a sensor element of the merchandise sensor, for example, an inductor electrically connected to the sensor electronics that generates a magnetic field by means of inductance so that changes in the energy field can be monitored by the sensor electronics. The horizontal axis of the graph of FIG. 4 indicates periodic time increments over which the sensor electronics is configured to sample, and in certain instances record, the output value of the sensor element. During a stable state, the sensor electronics preferably samples the output value provided by the sensor element periodically to calibrate an initial output value and thereby compensate for any natural electrical drift of the sensor element.

Until the time increment identified by 16, the item of merchandise is in a relatively stable state, for example, positioned in a desired display orientation on a merchandise display stand. Beginning at the time increment 16, the potential thief prematurely presses buttons or keys on the item of merchandise and then lifts the item of merchandise and the merchandise sensor from the merchandise display stand. The potential thief next removes (i.e., detaches) the item of merchandise from the merchandise sensor and thereafter drops the merchandise sensor without the item of merchandise over an edge of the display support. Prior to the time increment identified by 17, the merchandise sensor falls over the edge of the display support and bounces repeatedly for a period of time depending on the elasticity of a tether, cable or cord that mechanically, electrically or electromechanically connects the merchandise sensor to the merchandise display stand. From the time increment 16 until the time increment 17, the item of merchandise is in an interaction state and the sensor electronics ignores the output values periodically provided by the sensor element. As previously mentioned, the interaction state may be determined by the rate of change of the output values provided by the sensor element, or alternatively, by a kinetic sensor, such as an accelerometer, load cell or equivalent, disposed within the merchandise sensor. Regardless, the item of merchandise remains in the interaction state until the merchandise sensor comes to rest over the edge of the display support at time increment 17. Thereafter, the merchandise sensor without the item of merchandise is in a subsequent stable state. However, the output values provided by the sensor element in the subsequent stable state are not within (i.e., are outside) the predetermined tolerance bandwidth TB. Accordingly, the sensor electronics detects an "unsecured" or "alarm" condition and activates an alarm in response to the output values of the sensor element to alert security personnel to a possible theft.

Figure 5:
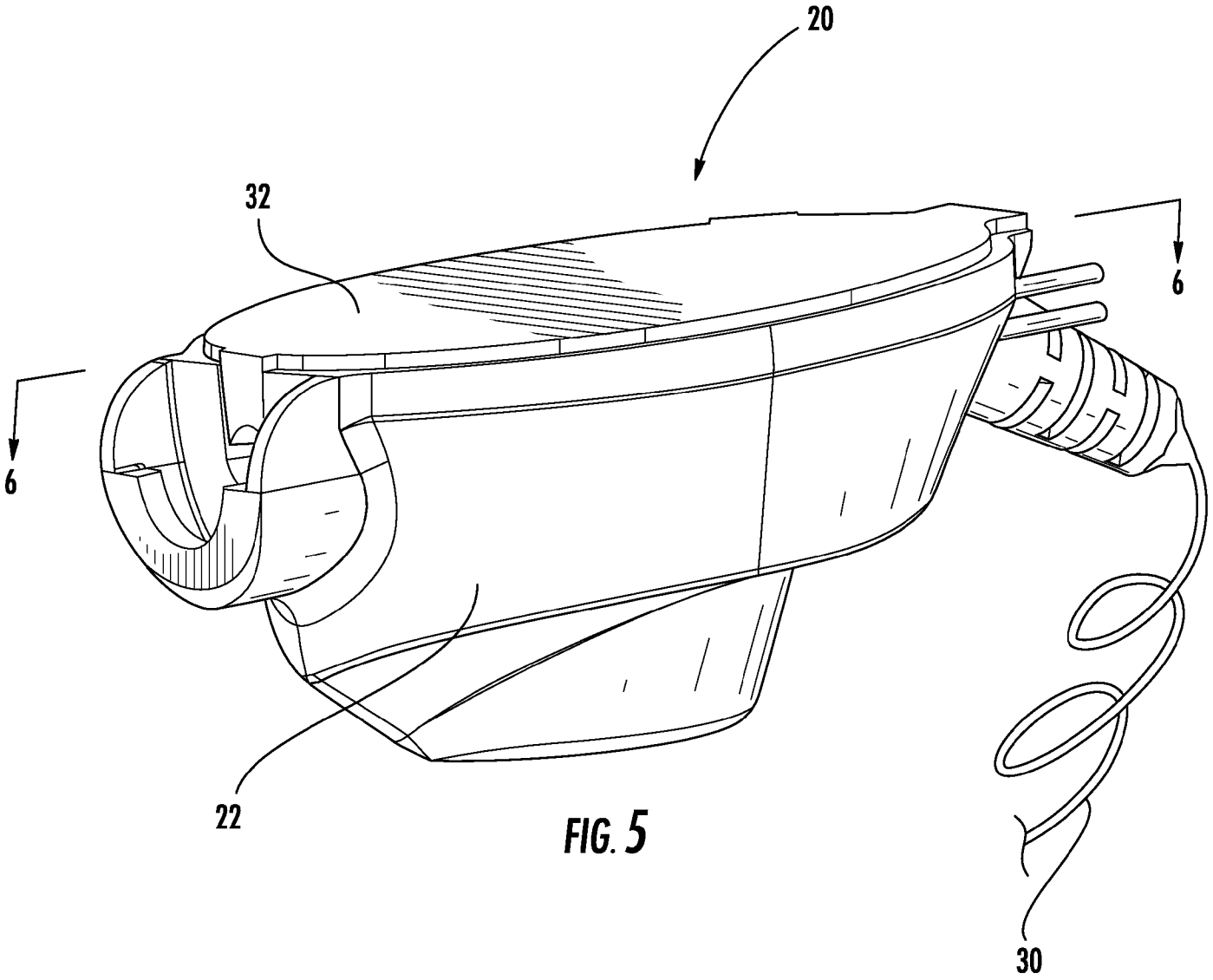
FIG. 5 is a perspective view of an exemplary embodiment of a merchandise sensor according to the present invention.
Figure 6:
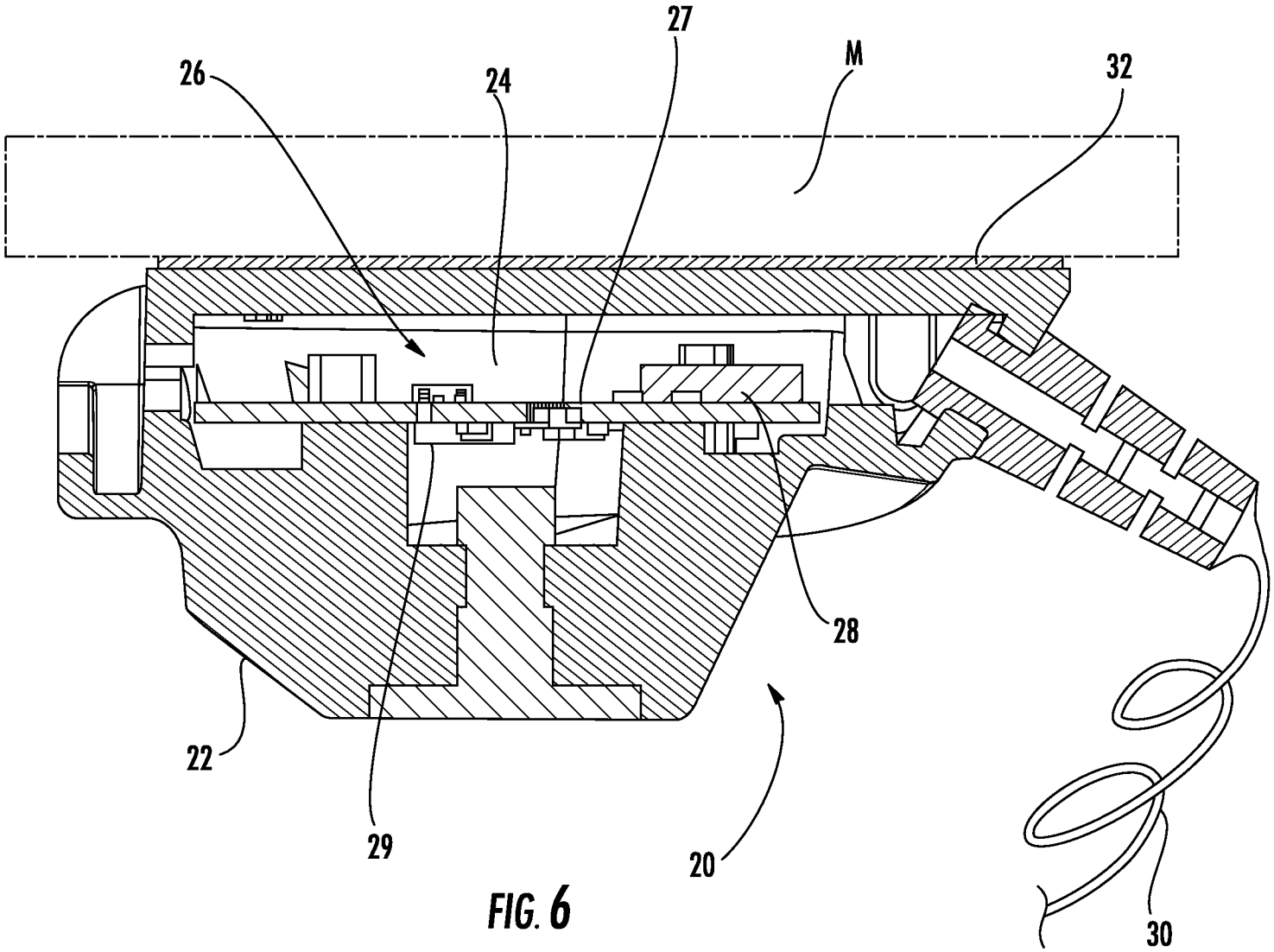
FIG. 6 is a sectional view of the merchandise sensor of FIG. 5 taken along the line 6-6 in FIG. 5.

A perspective view of an exemplary embodiment of a merchandise sensor, indicated generally at 20, according to the present invention is shown in FIG. 5. A sectional view of the merchandise sensor 20 taken along the line 6-6 in FIG. 5 is shown in FIG. 6. Merchandise sensor 20 comprises a generally hollow housing 22 defining an internal compartment or cavity 24 for housing various components of the sensor including, but not limited to, sensor electronics 26 and at least one sensor element 28. In an exemplary embodiment, the sensor electronics 26 is provided in the form of a conventional printed circuit board 27 having a plurality of electrical components and electrical connections disposed thereon in a known manner and operable for performing the desired functions of the merchandise sensor 20. In that regard, the printed circuit board 27 comprises at least a processor for controlling operations of the sensor electronics 26 and a memory for storing various operating instructions and parameters and of the merchandise sensor 20 as well as output values of the sensor element 28. As previously mentioned, the merchandise sensor 20 may further comprise a kinetic sensor 29, such as a load cell, vibration switch or accelerometer, for detecting and providing kinetic information relating to the item of merchandise. Alternatively, the sensor element 28 may also function as the kinetic sensor. Furthermore, the merchandise sensor 20 may optionally comprise a mechanical, electrical or electromechanical tether, cord, cable or the like 30 for connecting the merchandise sensor to a merchandise display security device (not shown), such as a display stand, an alarm module, a security fixture and the like. Furthermore, a thin layer of a pressure sensitive adhesive (PSA), such as double-sided tape, 32 may be provided for securing the item of merchandise M to the housing 22 of the merchandise sensor 20 in a known manner.

In the exemplary embodiment illustrated herein, the sensor element 28 is an inductor electrically connected to the sensor electronics 26 that generates an energy field by means of inductance so that changes in the energy field can be monitored by the sensor electronics. In an advantageous embodiment, the inductor generates a magnetic field by passing an electric current through a coil and the sensor electronics 26 converts the strength of the magnetic field to a numerical output value to be recorded by the memory of the sensor electronics and compared to the numerical output values corresponding to the predetermined tolerance band TB of the merchandise sensor 20. As will be readily apparent to those skilled in the art, the sensor element 28 may be any of a plurality of known sensors operable for detecting a variable or characteristic of an item of merchandise M attached to the merchandise sensor 20 and for providing an output value representative of a change in the variable or characteristic over time to the memory of the sensor electronics 26. By way of example, the sensor element 28 may alternatively be a variable resistance strain gauge, a load cell, an accelerometer, a density sensor, an acoustic sensor, a magnetic sensor (similar to the inductor described herein), a digital imaging or digital mapping sensor, or any other sensor capable of providing an output signal or value indicative of whether a variable or characteristic associated with the item of merchandise has been altered during a time period of interaction. Broadly, the sensor element 28 is operable to provide an initial output value associated with a variable or characteristic of an item of merchandise before a time period of interaction and to thereafter provide a subsequent output value associated with the same variable or characteristic of the item of merchandise immediately following the time period of interaction. The sensor electronics 26 functions to compare the subsequent output value and the initial output value to determine whether a change in the variable or characteristic of the item of merchandise indicates a possible theft. In the event of a possible theft, the sensor electronics 26 preferably activates an internal, external or remote alarm in a known manner (for example via conductors in cable 30, or alternatively, wirelessly) to alert security personnel to the possible theft.

That which is claimed is:

1. A merchandise sensor for a merchandise display security device, the merchandise sensor comprising:

sensor electronics; and a sensor element operably coupled to the sensor electronics, the sensor element providing an output value in at least an initial stable state and a subsequent stable state following an interaction state;

wherein the sensor electronics compares the output value of the sensor element in the initial stable state and the output value of the sensor element in the subsequent stable state following the interaction state to determine an alarm condition.

2. A merchandise sensor according to claim 1, wherein the sensor electronics compares the output value of the sensor element in the subsequent stable state to the output value of the sensor element in the initial stable state and determines the alarm condition in the event that the output value of the sensor element in the subsequent stable state is not within a predetermined tolerance bandwidth of the output value of the sensor element in the initial stable state.

3. A merchandise sensor according to claim 1, wherein the sensor electronics monitors the output value of the sensor element in the initial stable state and in the subsequent stable state.

4. A merchandise sensor according to claim 3, wherein the sensor electronics does not monitor the output value of the sensor element in the interaction state following the initial stable state.

5. A merchandise sensor according to claim 1, wherein the sensor element comprises an inductor for generating a magnetic field and wherein changes in the strength of the magnetic field are monitored by the sensor electronics to detect the alarm condition.

6. A merchandise sensor according to claim 1, further comprising an alarm operably coupled to the sensor electronics that is activated by the sensor electronics in response to the alarm condition.

7. A merchandise sensor according to claim 1, wherein the sensor electronics comprises a printed circuit board that is electrically connected to the sensor element.

8. A merchandise sensor for protecting an item of merchandise from theft, comprising:

sensor electronics; and a sensor element operably coupled to the sensor electronics;

wherein the sensor element is operable for generating an inductive energy field, and wherein the sensor electronics is operable for monitoring changes in the inductive energy field to detect an alarm condition based on changes in the inductive energy field, wherein the sensor element is operable for providing at least one output value and the sensor electronics is operable for monitoring an output value of the sensor element in a first stable state and an output value of the sensor element in a second stable state.

9. A merchandise sensor according to claim 8, wherein the sensor electronics ignores the output value provided by the sensor element during an interaction state.

10. A merchandise sensor according to claim 8, wherein the sensor electronics detects an alarm condition in the event that the output value provided by the sensor element in the second stable state does not fall within a predetermined tolerance bandwidth of the output value provided by the sensor element in the first stable state.

11. A merchandise sensor according to claim 10, wherein the sensor electronics further activates an alarm in response to the alarm condition.

12. A merchandise sensor according to claim 10, wherein the sensor electronics periodically samples the output value in the first stable state to calibrate an initial output value of the sensor element.

13. A merchandise sensor according to claim 12, wherein the sensor electronics further determines the predetermined tolerance bandwidth based on the initial output value of the sensor element in the first stable state.

14. A merchandise sensor according to claim 8, wherein the sensor element comprises an inductor electrically connected to the sensor electronics that generates the inductive energy field monitored by the sensor electronics.

15. A merchandise sensor according to claim 14, wherein the inductor generates a magnetic field by passing an electric current through a coil and wherein changes in the strength of the magnetic field are monitored by the sensor electronics to detect an alarm condition.

16. A merchandise sensor according to claim 8, wherein the sensor electronics comprises a printed circuit board and wherein at least the printed circuit board is disposed within an internal cavity defined by a housing that is adapted to be attached to the item of merchandise.

17. A merchandise sensor according to claim 8, wherein the sensor element is configured to be removably supported on a display stand or support.

18. A merchandise sensor according to claim 8, further comprising a housing configured to house the sensor electronics and the sensor element, wherein the housing is configured to be attached to an item of merchandise, and wherein the sensor electronics is configured to detect removal of the housing from the item of merchandise based on changes in the inductive energy field.

19. A merchandise sensor according to claim 8, wherein the sensor electronics is configured to compare the output value of the sensor element in the initial stable state and the output value of the sensor element in the subsequent stable state following an interaction state to determine an alarm condition.

20. A method for protecting an item of merchandise from theft comprising:

generating an inductive energy field with a sensor element, the sensor element operably coupled to sensor electronics; and providing an output value indicative of the inductive energy field to the sensor electronics in a first stable state and in a second stable state;

monitoring the output value of the sensor element in the first stable state and the output value of the sensor element in the second stable state; and determining an alarm condition with the sensor electronics based on changes in the inductive energy field.

21. A method for protecting an item of merchandise according to claim 20, wherein monitoring comprises comparing the output value of the sensor element in the first stable state and the output value of the sensor element in the second stable state following an interaction state.

22. A method for protecting an item of merchandise according to claim 20, wherein determining comprises determining the alarm condition in the event that the output value of the sensor element in the second stable state is not within a predetermined tolerance bandwidth of the output value of the sensor element in the first stable state.

23. A method for protecting an item of merchandise according to claim 20, further comprising activating an alarm in response to the alarm condition.

24. The method according to claim 20, wherein determining comprises determining whether the output value in the second stable state indicative of the inductive energy field is within a predetermined tolerance bandwidth.

* * * * *